US007673350B2

(12) United States Patent
Mazzoccoli et al.

(10) Patent No.: US 7,673,350 B2
(45) Date of Patent: Mar. 9, 2010

(54) UNIVERSAL SAFETY CAP

(75) Inventors: Jeff C. Mazzoccoli, Billings, MT (US); Dana J. Mazzoccoli, Billings, MT (US); Pasquale Dillon Mazzoccoli, Billings, MT (US); Julianne Marshall Mazzoccoli, Billings, MT (US); Jenna Alexandra Mazzoccoli, Billings, MT (US); Martin Albini, Bozeman, MT (US); Gordon C. Jenks, Moscow, ID (US)

(73) Assignee: Mazz Enterprises, LLC, Billings, MT (US)

( * ) Notice: Subject to any disclaimer, the term of this patent is extended or adjusted under 35 U.S.C. 154(b) by 1101 days.

(21) Appl. No.: 11/048,032

(22) Filed: Jan. 31, 2005

(65) Prior Publication Data

US 2006/0168712 A1 Aug. 3, 2006

(51) Int. Cl.
*A42B 3/00* (2006.01)

(52) U.S. Cl. ..... 2/411; 2/418

(58) Field of Classification Search ..... 2/410, 2/6.8, 411, 412, 414, 417–418
See application file for complete search history.

(56) References Cited

U.S. PATENT DOCUMENTS

| | | | | | |
|---|---|---|---|---|---|
| 2,218,947 | A | | 10/1940 | Brunzell | |
| 2,785,407 | A | * | 3/1957 | Reeder | 2/22 |
| 4,439,871 | A | | 4/1984 | Plastino | |
| 5,226,180 | A | | 7/1993 | Leach | |
| 5,269,026 | A | | 12/1993 | McManus | |
| 5,289,591 | A | | 3/1994 | Andersen | |
| 5,351,342 | A | * | 10/1994 | Garneau | 2/414 |
| 5,361,410 | A | * | 11/1994 | Sigl | 2/465 |
| 5,365,615 | A | * | 11/1994 | Piszkin | 2/422 |
| 5,437,064 | A | | 8/1995 | Hamaguchi | |
| D364,496 | S | | 11/1995 | Lejuez | |
| 5,519,895 | A | | 5/1996 | Barnes, Jr. | |
| 5,657,492 | A | | 8/1997 | Esposito, Jr. | |
| 5,713,082 | A | * | 2/1998 | Bassette et al. | 2/412 |
| 5,729,830 | A | * | 3/1998 | Luhtala | 2/2.5 |
| 5,887,289 | A | | 3/1999 | Theoret | |
| 6,263,515 | B1 | | 7/2001 | Turner et al. | |
| D458,737 | S | | 6/2002 | Fuerst | |
| 6,539,556 | B1 | | 4/2003 | Barker | |
| 6,647,556 | B2 | * | 11/2003 | Grepper et al. | 2/425 |
| 7,103,923 | B2 | * | 9/2006 | Picotte | 2/412 |
| 2004/0034903 | A1 | | 2/2004 | Blair | |
| 2004/0226077 | A1 | * | 11/2004 | Toth | 2/411 |

* cited by examiner

*Primary Examiner*—Shaun R Hurley
*Assistant Examiner*—Andrew W Sutton
(74) *Attorney, Agent, or Firm*—Antoinette M. Tease

(57) ABSTRACT

A safety cap comprising a plurality of rigid plates, a foam insert, and an outer covering. The rigid plates are embedded within the foam insert, and the foam insert comprises foam joints. A safety cap comprising a plurality of cushions, a rigid shell, and an outer covering. The cushions are attached to the inside of the rigid shell, and they comprise a plurality of nozzles. A safety cap in which rigid plates and cushions are embedded within a foam insert. The cushions are positioned on the inner surface of the rigid plates and may contain air, foam, fluid or a combination thereof. The outer covering is preferably made of fabric, and the cap preferably comprises an adjustable strap. The cap optionally includes ventilation holes, ear cutouts, eye cutouts, a ponytail cutout, an eye protector and/or a face protector.

14 Claims, 7 Drawing Sheets

UNIVERSAL SAFETY CAP

BACKGROUND OF THE INVENTION

1. Field of the Invention

The present invention relates to the field of protective head gear. More particularly, the present invention is a universal safety cap that is intended to prevent head injuries caused by a fall, projectile, or other impact to the head. Although the present invention is not limited to any particular application, the safety cap was designed primarily to be worn by youths when playing baseball. The safety cap may be worn in connection with athletic or industrial activities or for general safety purposes (for example, it may be worn by toddlers or the elderly).

2. Description of the Related Art

A number of devices that are intended to provide protection to the head of an athlete during competition or practice have been patented or are the subject of pending patent applications. More specifically, there are several patented and "patent pending" inventions that are intended to look more like a hat than a helmet and to provide protection to the wearer during games like baseball and golf, where the face is generally exposed, as opposed to football and hockey, where the degree of protection over the face and ears is much greater.

Despite the relative perceived safety of baseball as opposed to some other sports, there have been a number of injuries and even deaths caused by a baseball hitting a player's head at a high speed and/or at an area of the head (such as the temple) that can cause serious injury. Unlike any prior art device, the present invention is designed specifically to prevent such injuries while preserving comfort and remaining relatively inconspicuous. Some of the prior art devices are described below.

U.S. Pat. No. 5,226,180 (Leach, 1993) relates to a piece of protective headgear with an outer cover that looks like a baseball cap and an inner shell that is made of a rigid foamed material. The shell includes a multitude of ventilation openings. The outer cover is made of fabric, and there are fabric spacer elements with a resilient pile between the outer cover and the inner shell.

U.S. Pat. No. 5,887,289 (Theoret, 1999) provides a safety cap with a removable fabric cover and an inner, one-piece shell made of an impact-resistant, rigid material. This invention appears to be an improvement over the Leach device in that the outer fabric cover includes a foldable dependent flange that hangs down loosely from the outer cover when not folded. When folded, the flange encloses the exposed edge of the inner shell. The flange also includes a cushioning pad.

U.S. Pat. No. 5,289,591 (Andersen, 1994) provides a hemispherical plastic dome, designed to fit the shape of a human head, that is intended to be inserted inside a golf or baseball cap. Like the present invention, an object of the Andersen invention is to provide protection to the head without changing the outward appearance of the cap. This particular device, however, has a cutout in the rear of the dome. The purpose of the cutout is to allow the size of the baseball cap to be adjusted.

U.S. Pat. No. 5,269,026 (McManus, 1993) is like the Andersen patent in that it provides an adjustable cap with a safety liner. The safety liner includes cutout sections and is designed to only partially encircle the head of a wearer. A large cutout is provided at the rear of the head of the wearer. The rear cutout is designed to provide increased flexibility of the outer shell and inner liner so that the size of the safety liner can be adjusted.

U.S. Pat. No. 2,333,987 (Dandy, 1943) provides a protective head covering for people engaged in hazardous occupations. It is particularly designed to be worn with baseball caps. The invention comprises a fabric body, a lining, and a relatively rigid curved shield member that is inserted into a pocket that is formed by the body and lining. The shield member covers on the side of the head.

U.S. Pat. No. 6,539,556 (Barker, 2003) discloses a protective headwear device that protects only the scalp of the wearer.

U.S. Pat. No. 5,519,895 (Barnes, Jr., 1996) covers a baseball-type cap for use over a conventional sports helmet, such as a bicycle helmet. The cap is held in place by an elastic band that fits tight against the head.

U.S. Pat. No. 5,657,492 (Esposito, Jr., 1997) involves a protective head apparatus that covers only the occipital region of the wearer's head. The apparatus is intended to protect the wearer from injuries sustained during falls.

U.S. Pat. No. 4,439,871 (Phastino, 1984) discloses an outer head covering and a removable protective impact-resistant shell. The outer covering has a crown portion, a shell-receiving opening, and a brim. The shell is held in place by straps that extend from the exterior surface of the shell and pass through strap-receiving openings in the crown portion of the outer head covering.

U.S. Pat. No. 5,729,830 (Luhtala, 1998) describes a piece of protective headgear designed to protect the wearer against ballistic projectiles. The device consists of several protective layers of fabric and at least one damping layer composed of closed cell material.

U.S. Pat. No. 2,218,947 (Brunzell, 1940) provides a safety cap for ball players, but the rigid, protective part only extends around the circumference of the wearer's head, and the top of the head is unprotected.

Although not designed specifically for use in athletics, U.S. Pat. No. 6,263,515 (Turner et al., 2001) provides a type of protective headgear for children. The device includes a frame with an adjustable and padded band, a visor, and four arcuate cover support members. The device also includes a cover with a tail-like portion that extends downward and protects the back of the child's neck.

U.S. Pat. No. 5,437,064 also involves protective headgear for children. This invention has three components: a first padding assembly, a second padded assembly, and an outer hat assembly. The first padding assembly comprises a stretchable circular padding band and a plurality of semi-circular padding bands that overlay each other at a ninety-degree angle. The second padded assembly is hemispherically shaped, preferably made of resilient foam, and fits underneath the first padded assembly. The outer hat assembly is a hat with a visor. The device includes a chin strap.

U.S. Patent Application No. 2004/0034903 (Blair) describes a protective sports hat insert device that has a hard outer shell and an inner liner of high-density foamed plastic. Alternatively, the liner uses an Air Management System (AMS) technology. According to the patent application, the AMS provides an adaptive, energy-absorbing layer with a plurality of air-filled cells jointed together by fluid flow passageways. The cells also include pressure-responsive seals that restrict fluid flow between the cells when the cells are subjected to a mechanical force above a pre-selected level. The device is intended to be inserted into a baseball cap.

In addition to the utility patents and patent application described above, there are a couple of design patents covering protective hats or hat inserts for athletic use. These patents include U.S. Pat. No. D458,737 (Fuerst, 2002) and U.S. Pat.

No. D364,496 (Lejuez, 1995). Neither of these design patents depicts a protective cap as shown in connection with the present invention.

It is an object of the present invention to provide a functional safety cap that is superior to prior art in terms of providing impact-resistance while still preserving the comfort of the wearer. It is a further object of the present invention to provide protection in the temple and occipital areas of the skull and optionally to provide eye and face/ear protection. It is a further object of the present invention to provide a safety cap that is relatively inconspicuous. It is a further object of the present invention to provide a safety cap that is particularly suitable for baseball, although not limited to that sport or to an athletic activity. The safety cap of the present invention is superior to prior art because it provides greater protection, better comfort, wider versatility and desirable aesthetics while taking advantage of modern manufacturing processes.

BRIEF SUMMARY OF THE INVENTION

The present invention covers three different embodiments of a universal safety cap. In the first embodiment, the safety cap comprises a plurality of rigid plates, a foam insert, and an outer covering. The rigid plates are embedded within the foam insert, and the outer covering is preferably comprised of fabric. The foam insert and the rigid plates each comprise(s) a plurality of preferable but optional ventilation holes, and the foam insert also comprises foam joints. The foam insert is optionally comprised of two ear cutouts, a ponytail cutout, and two eye cutouts. The safety cap further comprises an adjustable strap, as well as an optional occipital extension. The safety cap optionally comprises an eye protector and/or a face protector, which are either permanently or removably attached to the rigid plates.

The second embodiment of the present invention is a safety cap comprising a plurality of cushions, a rigid shell, and an outer covering. The cushions are attached to the inside of the rigid shell, and the outer covering is preferably comprised of fabric. The cushions are comprised of an outer layer of air-impermeable material, an inner core of air, fluid, or any combination of these substances, and optionally a plurality of nozzles. The cushions may contain nozzles that release air, foam, fluid or any combination thereof from the inner core at a controlled rate. The nozzles preferably vent to the atmosphere, but they could also vent to adjacent cushions by sharing interconnected nozzles. The rigid shell optionally comprises ventilation holes, two ear cutouts, two eye cutouts, and a ponytail cutout. It also optionally comprises an adjustable strap, as well as an optional occipital extension. The safety cap optionally comprises an eye protector and/or a face protector, which are either permanently or removably attached to the rigid shell.

The third embodiment of the present invention combines the foam insert and rigid plates of the first embodiment with the cushions of the second embodiment. In this embodiment, the cushions are placed adjacent to the inside of the rigid plates, so that both the rigid plates and the cushions are embedded within the foam insert. The cushions are comprised of an outer layer of air-impermeable material, an inner core of air, fluid, or any combination of these substances, and optionally a plurality of nozzles. The cushions may contain nozzles that release air, foam, fluid or any combination thereof from the inner core at a controlled rate. The nozzles preferably vent to the atmosphere, but they could also vent to adjacent cushions by sharing interconnected nozzles. This embodiment includes all of the optional features of the previous two embodiments.

REFERENCE NUMBERS

Figure 1:
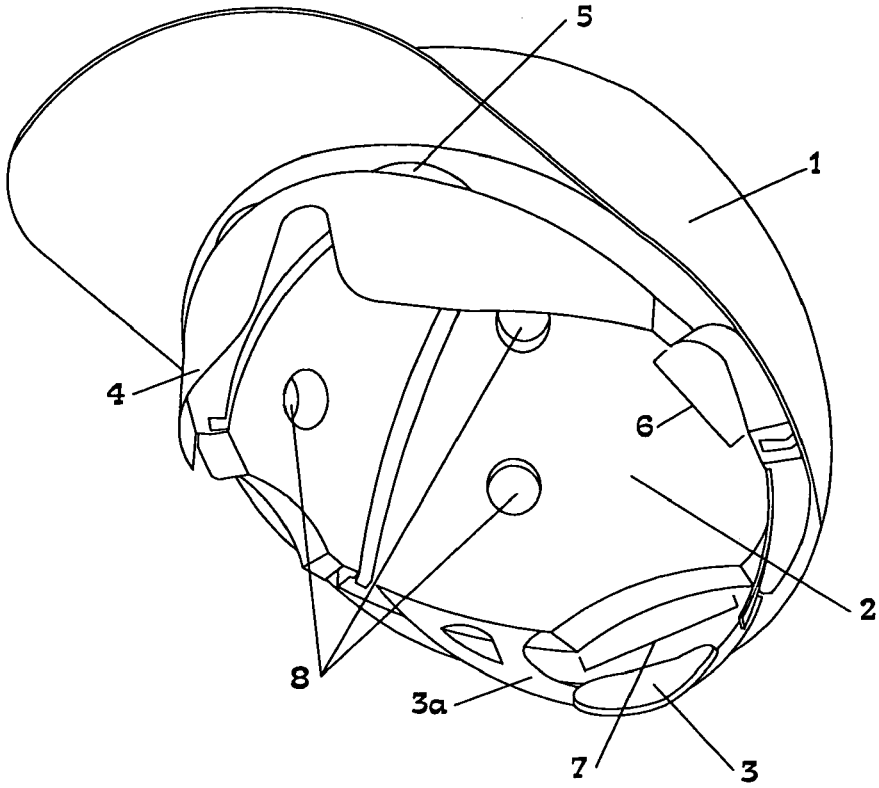
FIG. 1 is a perspective view of a first embodiment of the present invention with the outer covering and eye protector.

1 Outer covering
2 Foam insert
3 Small plate
3*a* Adjustable strap
4 Eye protector
4*a* Face protector
4*b* Ventilation hole (in the face protector)
4*c* Ear extension
5 Eye cutout
6 Ear cutout
7 Ponytail cutout
8 Ventilation hole (in the foam insert and rigid plates)
9 Rigid plate
10 Foam joint
11 Occipital extension
12 Cushion
13 Rigid shell
13*a* Bill
14 Nozzle

DETAILED DESCRIPTION OF INVENTION

A first embodiment of the present invention is depicted in FIGS. 1-7. In this embodiment, a plurality of rigid plates is embedded within a resilient foam insert. FIG. 1 is a perspective view of the first embodiment with the outer covering 1 and eye protector 4. The outer covering 1 is preferably made of fabric and shaped like a baseball hat. The outer covering is attached to a foam insert 2 by hook and loop or other suitable fasteners (not shown) on the inside of the outer covering and the outside of the foam insert 2. The foam insert is preferably made of polystyrene or poly vinyl acetate. The foam insert contains optional but preferable ventilation holes 8 and optional cutouts for the ears 6, eyes 5, and ponytail 7. This embodiment includes an adjustable strap 3*a*, which is held in place on the back of the head by a small plate 3.

This embodiment optionally includes an eye protector 4, which is either permanently or removably attached to the foam insert 2. The eye protector is transparent and is preferably made of polycarbonate or polyethylene terephthalate. The eye protector is preferably attached to the rigid plates 9. The present invention is not limited to any particular method of attaching the eye protector to the rigid plates. Two possible methods of attaching the eye protector to the rigid plates include: (i) where the eye protector comprises a frame, attaching (as in heat welding or riveting) the frame to the rigid plates inside the foam insert and (ii) attaching (as in heat welding or riveting) the eye protector to tabs in the rigid plates that protrude through the foam insert. The eye protector may also be attached to the foam insert by attaching the frame of the eye protector to a fastener embedded in the foam insert, but this method will not provide as much stability as attaching the eye protector to the rigid plates.

Figure 2:
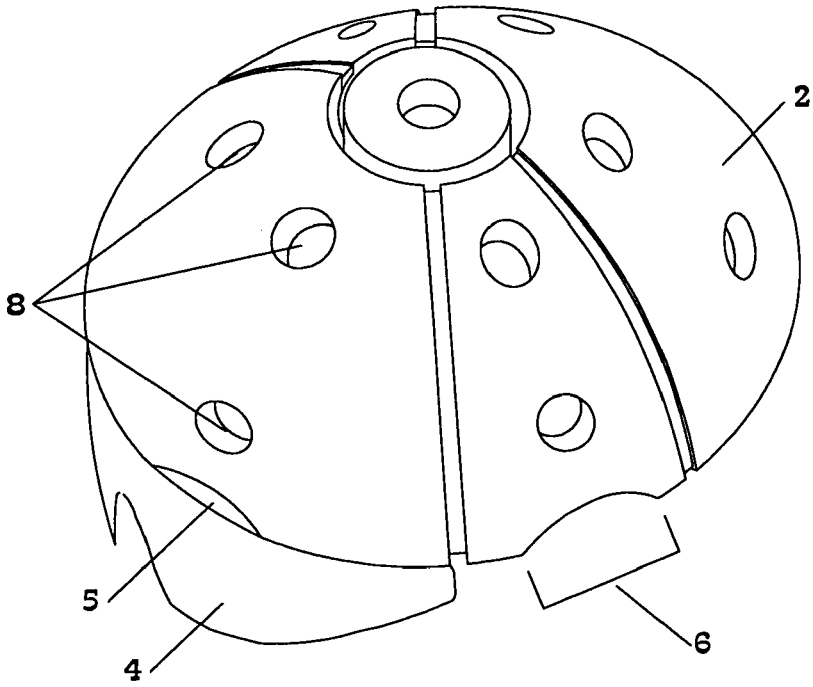
FIG. 2 is a perspective view of a first embodiment of the present invention without the outer covering.

FIG. 2 is a perspective view of a first embodiment of the present invention without the outer covering 1. This figure shows more clearly the optional ventilation holes 8 in the foam insert 2. It also shows the eye protector 4, one of the eye cutouts 5, and one of the ear cutouts 6. The particular configuration of the ventilation holes 8 shown in this figure is for illustrative purposes only; the present invention is not limited to any particular shape, number or configuration of ventilation holes 8.

Figure 3:
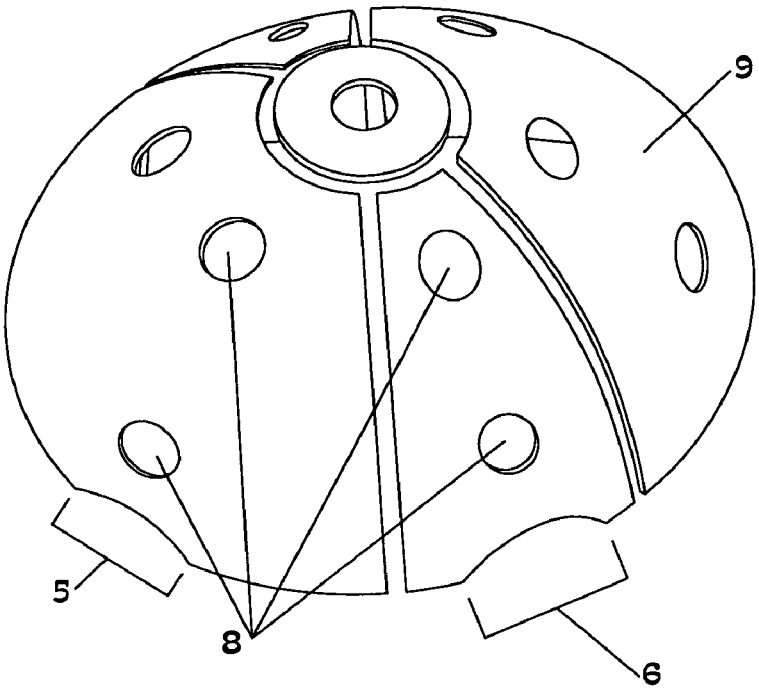
FIG. 3 is a perspective view of the rigid plates of the first embodiment of the present invention.

FIG. 3 is a perspective view of the rigid plates of the first embodiment of the present invention. In this embodiment, rigid plates 9 are embedded within the foam insert 2. These rigid plates are not visible in FIGS. 1 and 2. The rigid plates are preferably made of polypropylene or polycarbonate, and they contain ventilation holes 8. Although the present invention is not limited to any particular configuration of ventilation holes 8, the configuration of ventilation holes 8 on the rigid plates 9 is preferably the same as the configuration of the ventilation holes 8 on the foam insert 2. Note that the rigid plates are preferably not one piece but a plurality of separate pieces.

Figure 4:
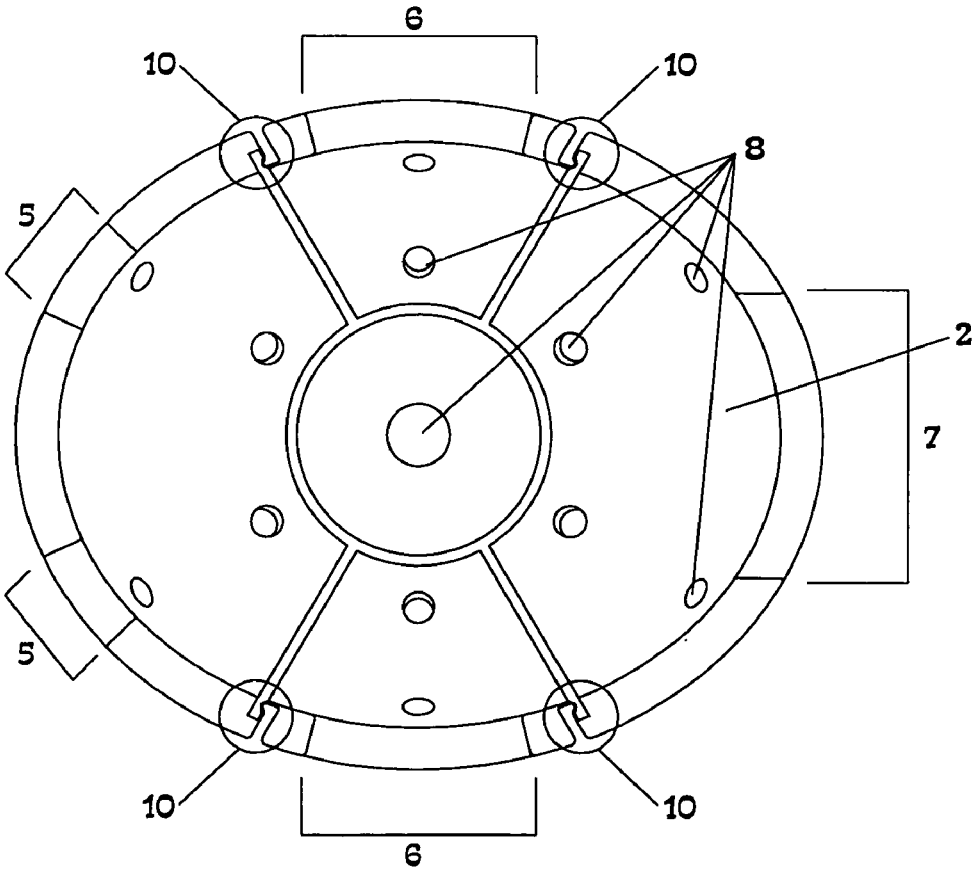
FIG. 4 is a bottom view of a first embodiment of the present invention.

FIG. 4 is a bottom view of a first embodiment of the present invention. This figure shows the foam insert 2, ventilation holes 8, ear cutouts 6, ponytail cutout 7, and eye cutouts 5. This figure also shows foam joints 10 that are integral to the foam insert 2. Alternately, the foam joints could be made out of fabric and stitched to the rigid plates. The foam joints 10 provide additional flexibility to the foam insert 2, and they allow the foam insert to stretch over the wearer's head. The outer covering 1 prevents the foam insert from stretching too far. Note that the foam joints 10 correspond to the spaces between the rigid plates shown in FIG. 3.

Figure 5:
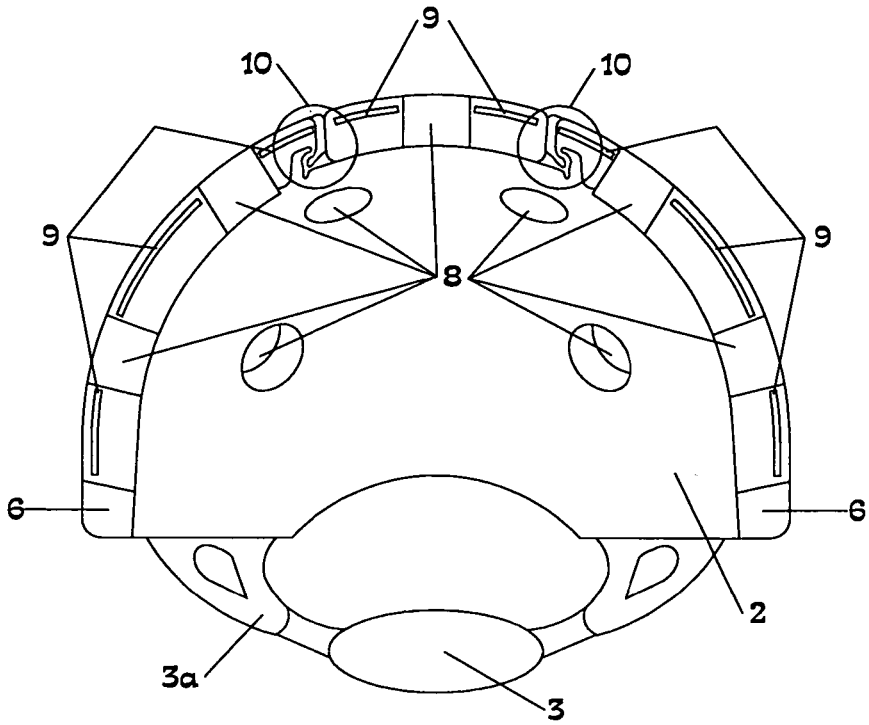
FIG. 5 is a section view of a first embodiment of the present invention.

FIG. 5 is a section view of a first embodiment of the present invention. This section view shows the rear portion of the first embodiment of the present invention, including the adjustable strap 3*a* and small plate 3. It also shows the foam insert 2 and the rigid plates that are embedded within the foam insert 9.

Figure 6:
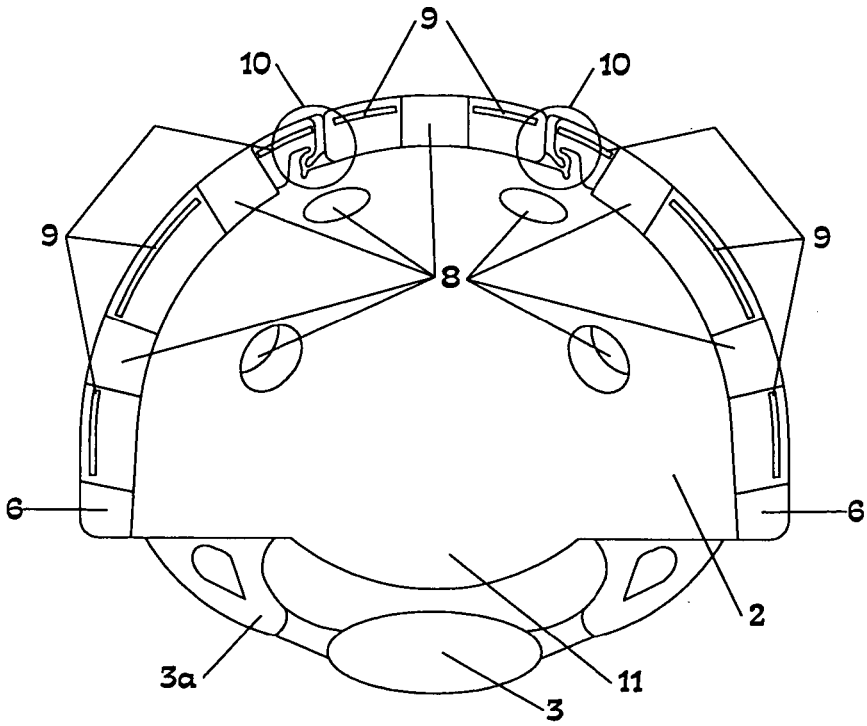
FIG. 6 is a section view of a first embodiment of the present invention, with additional occipital protection.

FIG. 6 is a section view of a first embodiment of the present invention, with additional occipital protection. This figure is similar to FIG. 5 except that it shows an optional occipital extension 11, which can be used if additional occipital protection is desired. The occipital extension 11 is preferably integral with the foam insert 2. If an occipital extension 11 is present, the ponytail cutout 7 (not shown) may have to be eliminated or reduced in size.

Figure 7:
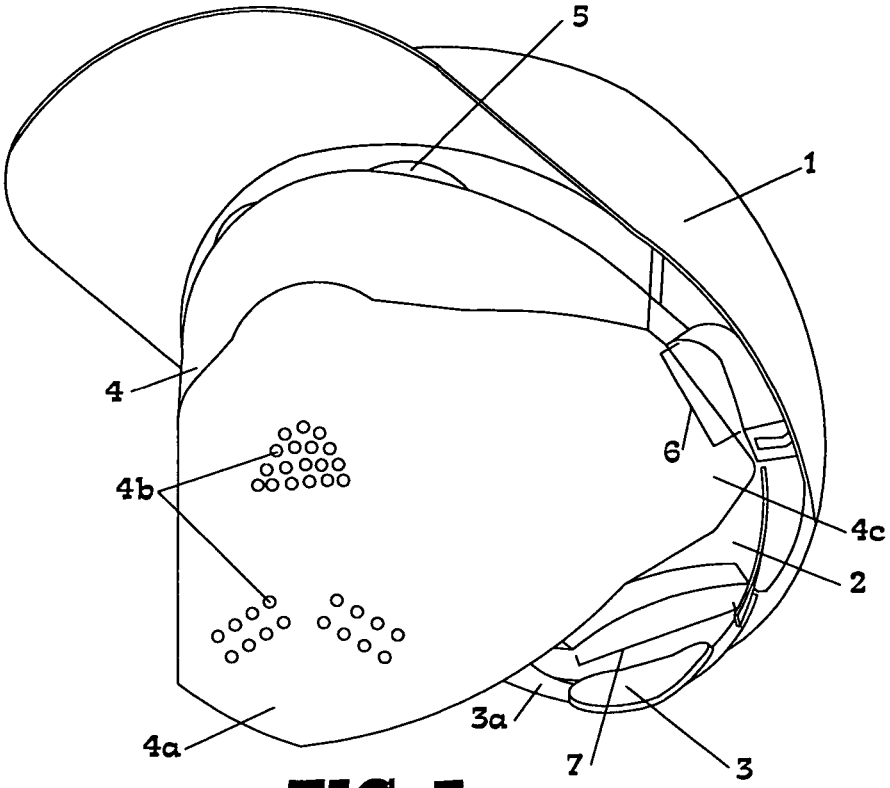
FIG. 7 is a perspective view of a first embodiment of the present invention with the outer covering and face protector.

FIG. 7 is a perspective view of a first embodiment of the present invention with the outer covering 1 and face protector 4*a*. FIG. 7 is similar to FIG. 1 except that it shows an optional face protector 4*a* in addition to the eye protector 4. The face protector may be made of any suitably rigid or flexible material, such as polycarbonate, polyethylene terephthalate, or thermoplastic. In certain sports, such as street hockey, it may be preferable to have a face protector made of a rigid material. In other sports, such as paintball, it may be preferable to have a face protector made of a more flexible material. The face protector attaches directly to the rigid plates (not shown). The present invention is not limited to any particular method of attaching the face protector to the rigid plates, although the same methods of attachment described for the eye protector could apply to the face protector. The face protector is either permanently or removably attached to the rigid plates. The face protector is preferably integral with the eye protector, but it may also be a separate piece that attaches either to the eye protector or the rigid plates in addition to the eye protector. The face protector may be either transparent in its entirety, or the part of the face protector that is over the eyes may be transparent while the rest of the face protector is opaque. The face protector optionally includes ventilation holes 4*b*, and ear extensions 4*c*.

Figure 8:
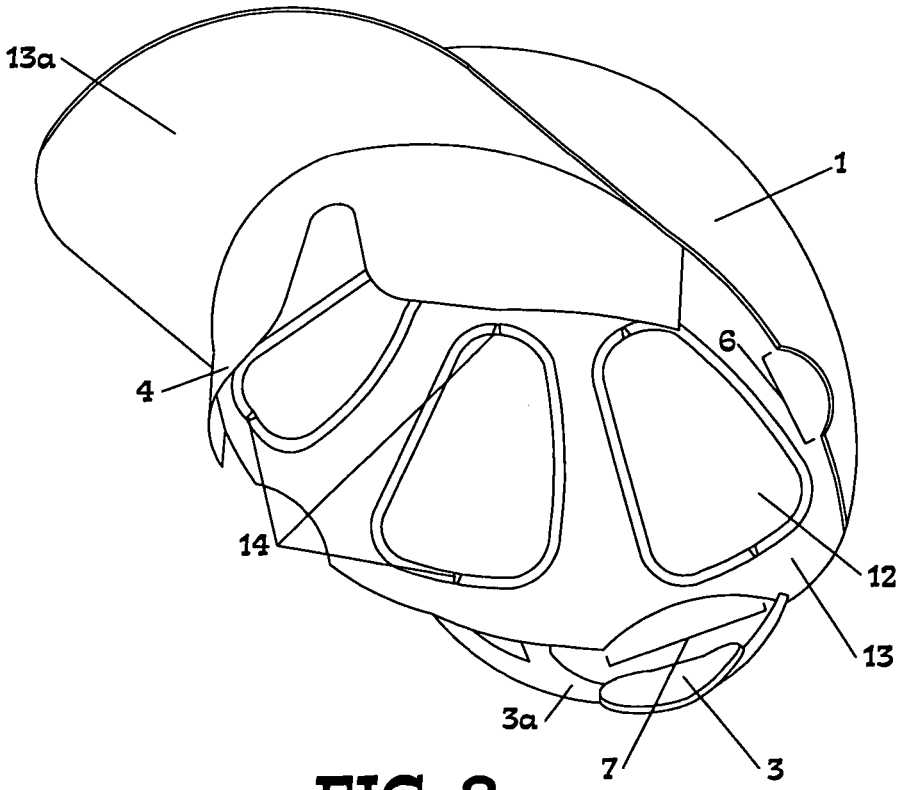
FIG. 8 is a perspective view of a second embodiment of the present invention with the outer covering and eye protector.

FIG. 8 is a perspective view of a second embodiment of the present invention with the outer covering 1 and eye protector 4. As in the first embodiment, the outer covering 1 is preferably made of fabric and shaped like a baseball hat. The outer covering 1 is attached to a rigid shell 13 by hook and loop or other suitable fasteners (not shown) on the inside of the outer covering and the outside of the rigid shell 13. The bill 13*a* is either integral with the rigid shell (as shown in FIGS. 9, 10, 11 and 13), or it is integral with the outer covering 1. The rigid shell is made of any sufficiently rigid and durable material, such as thermoplastic, polypropylene or polycarbonate.

Attached to the inside of the rigid shell is a plurality of cushions 12. The cushions are attached to the rigid shell by VELCRO®, glue, snaps or any other suitable means of attachment. Each cushion 12 consists of an outer layer of air-impermeable material with an inner core of air, foam (preferably open-celled foam, and more specifically, preferably polystyrene or urethane), or fluid. The outer layer of the cushions 12 is preferably made of vinyl or polybutyrate. The outer layer of each cushion 12 is sealed except for a nozzle or series of nozzles 14, which are preferably made of polycarbonate or polybutyrate. The inner core of the cushion is sufficiently dense and thick to hold the rigid shell 13 away from the wearer's head.

During an impact, the nozzles 14 control the flow of material (e.g., air, foam or fluid) out of the cushion 12 to regulate the deceleration of the baseball or other object hitting the cap. The controlled release of material from the cushion upon impact from an object helps control the rate of cushion deflation and, therefore, helps manage the deceleration of the impacting object. The controlled cushion deflation helps manage the forces of impact for the purpose of reducing the potential for head injury. The nozzles 14 are preferably placed along the sides of the cushions so that they do not vent against the wearer's head. In FIGS. 8 and 10-13, the nozzles 14 are located at the top and bottom of each cushion. The present invention is not limited to any particular number or location of nozzles, however. In fact, the nozzles could be situated so that rather than venting into the atmosphere, they vent into other cushions. The interconnection of nozzles to adjacent cushions would cause fluid (or air, foam) to vent through the nozzle to an adjacent cushion upon object impact. The resultant increased pressure in the cushions would provide resistance to impact by managing the rate of cushion deflation and thus impact deceleration.

In this embodiment, the rigid shell 13 surrounds the cushions 12 and distributes the force of the impact over a number of cushions 12. FIG. 8 also shows the optional eye protector 4, ear cutouts 6, ponytail cutout 7, adjustable strap 3*a* and small plate 3. Although not shown, this embodiment may also include optional eye cutouts 5. The shape and placement of the cushions can be altered to accommodate the ear and ponytail cutouts. In this embodiment, the eye protector 4 attaches directly to the rigid shell 13.

Figure 9:
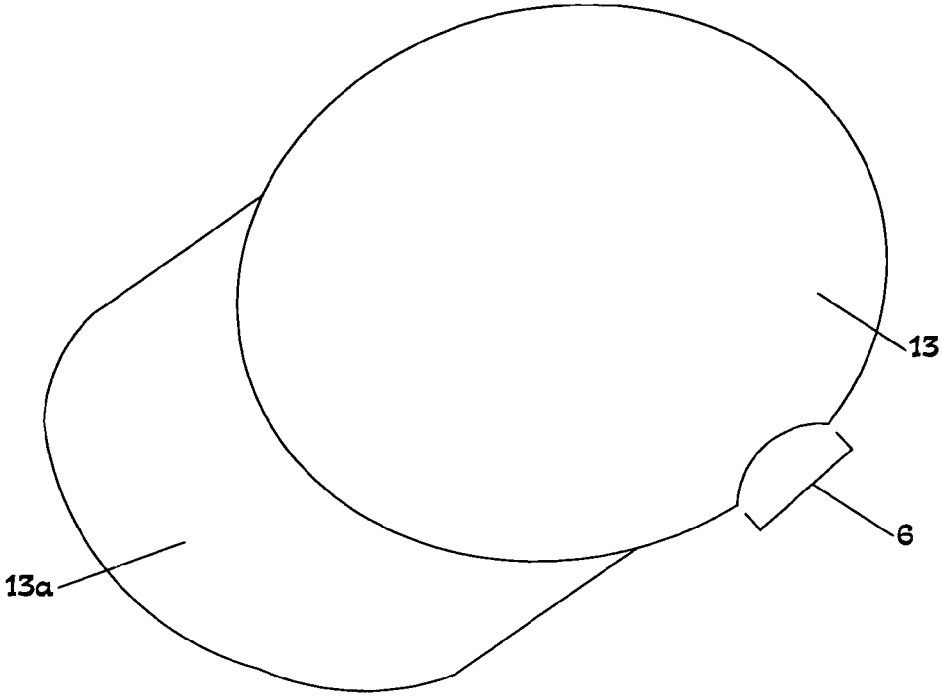
FIG. 9 is a perspective view of the rigid shell of the second embodiment of the present invention without the outer covering.

FIG. 9 is a perspective view of the rigid shell of the second embodiment of the present invention without the outer covering. The cushions 12 and nozzles 14 are not visible in this figure because they are on the interior of the rigid shell. This figure does show the optional ear cutout 6. Although the rigid shell is shown without ventilation holes, it may optionally include ventilation holes.

Figure 10:
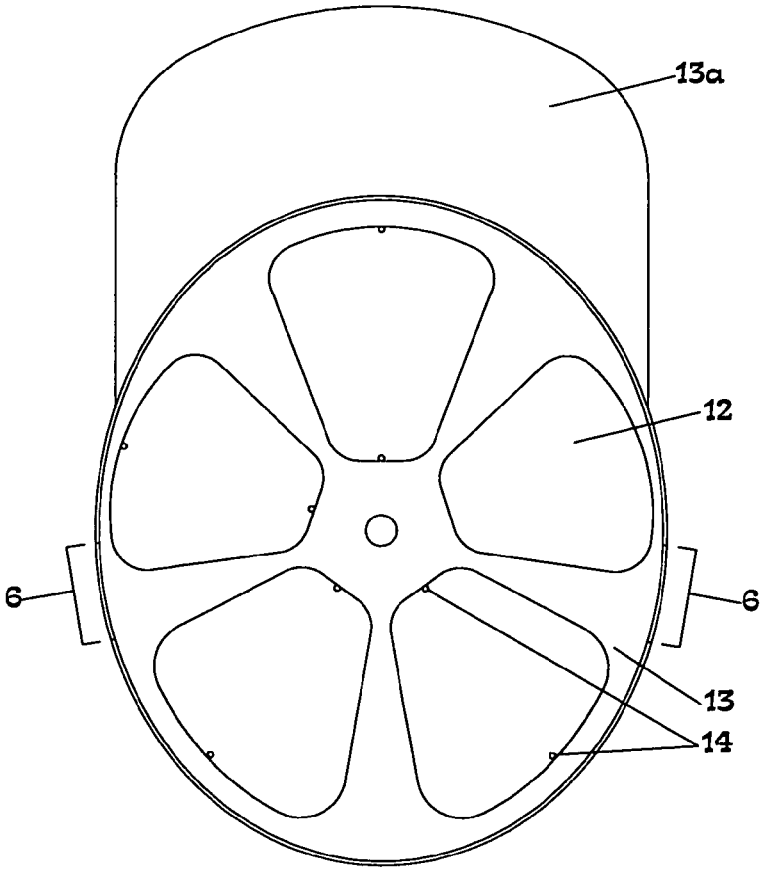
FIG. 10 is a bottom view of a second embodiment of the present invention.

FIG. 10 is a bottom view of a second embodiment of the present invention. This figure shows the cushions 12, rigid shell 13, and nozzles 14. This figure shows one particular array of cushions, but the present invention is not limited to any particular shape, number or array of cushions.

Figure 11:
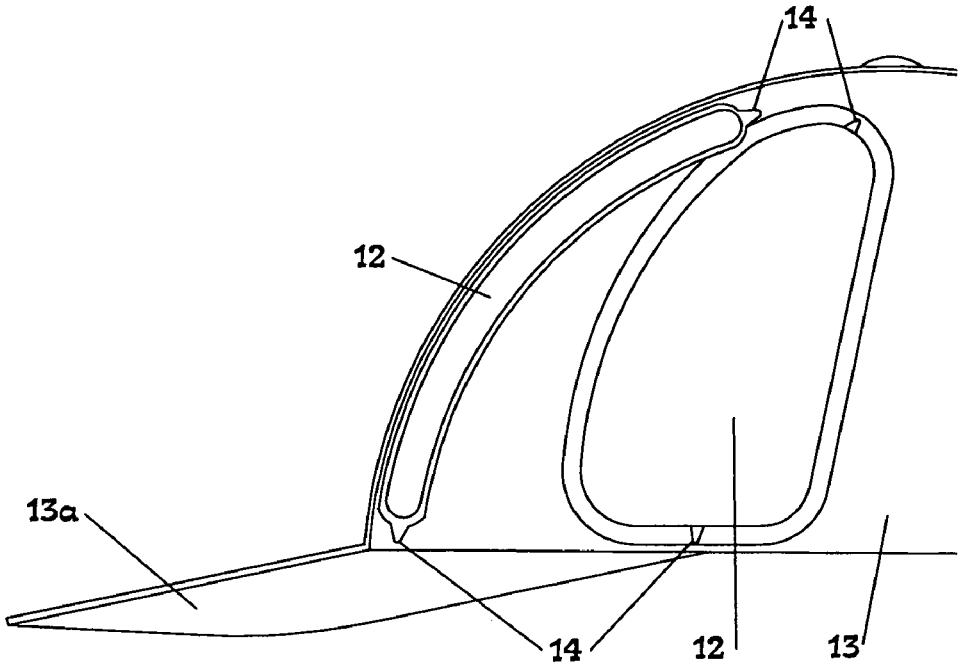
FIG. 11 is a partial section view of a second embodiment of the present invention.

FIG. 11 is a partial section view of a second embodiment of the present invention. This figure shows the orientation of one of the cushions 12 on the inside of the rigid shell 13.

Figure 12:
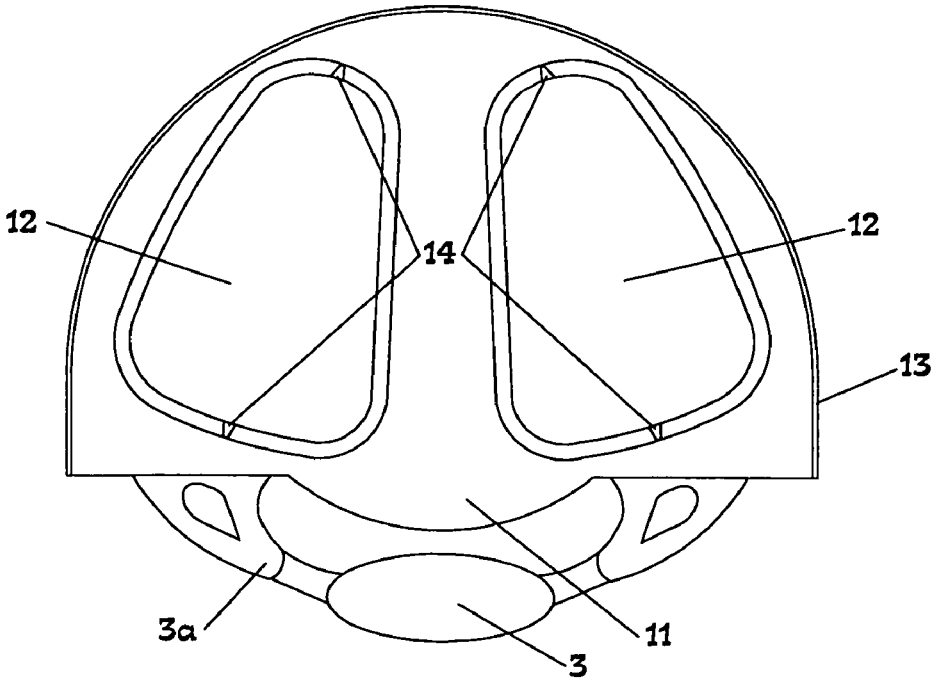
FIG. 12 is a section view of a second embodiment of the present invention, with additional occipital protection.

FIG. 12 is a section view of a second embodiment of the present invention, with additional occipital protection. This figure shows the rear portion of the second embodiment of the present invention, including the adjustable strap 3*a* and small plate 3. It also shows the cushions 12 and rigid shell 13. In addition, this figure shows an optional occipital extension 11, which can be used if additional occipital protection is desired. The occipital extension 11 is preferably integral with the rigid shell 13. If an occipital extension 11 is present, the ponytail cutout 7 (not shown) may have to be eliminated or reduced in size.

Figure 13:
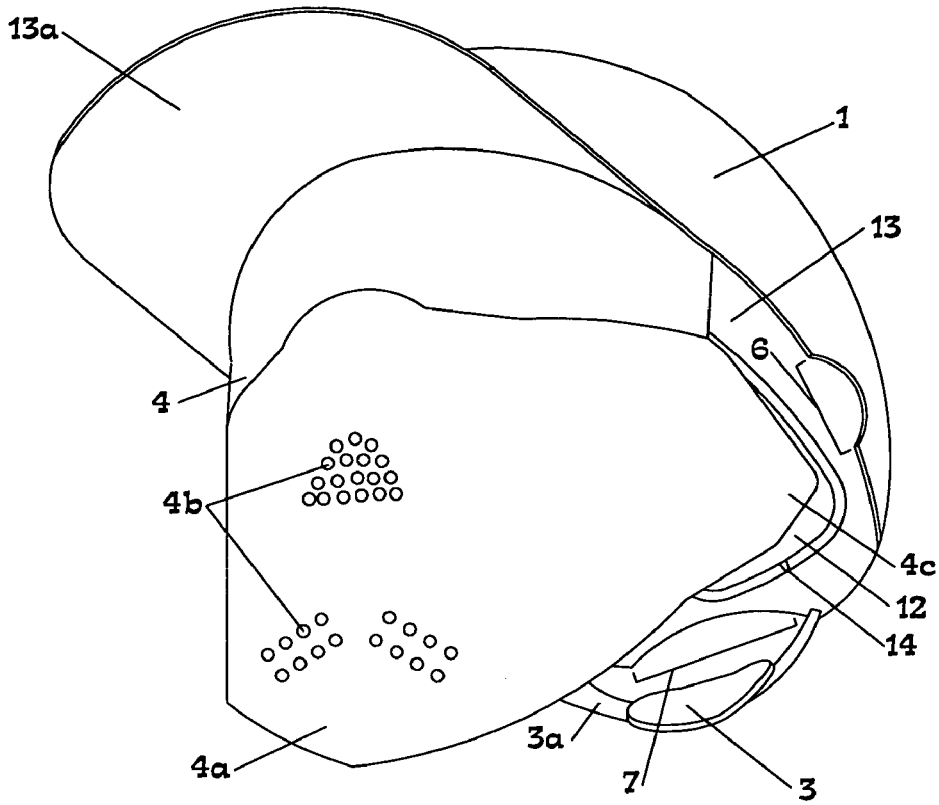
FIG. 13 is a perspective view of a second embodiment of the present invention with the outer covering and face protector.

FIG. 13 is a perspective view of a second embodiment of the present invention with the outer covering 1 and face protector 4*a*. FIG. 13 is similar to FIG. 8 except that it shows an optional face protector 4*a* in addition to the eye protector 4. In this embodiment, the face protector 4*a* can be either permanently or removably attached to the rigid shell.

Figure 14:
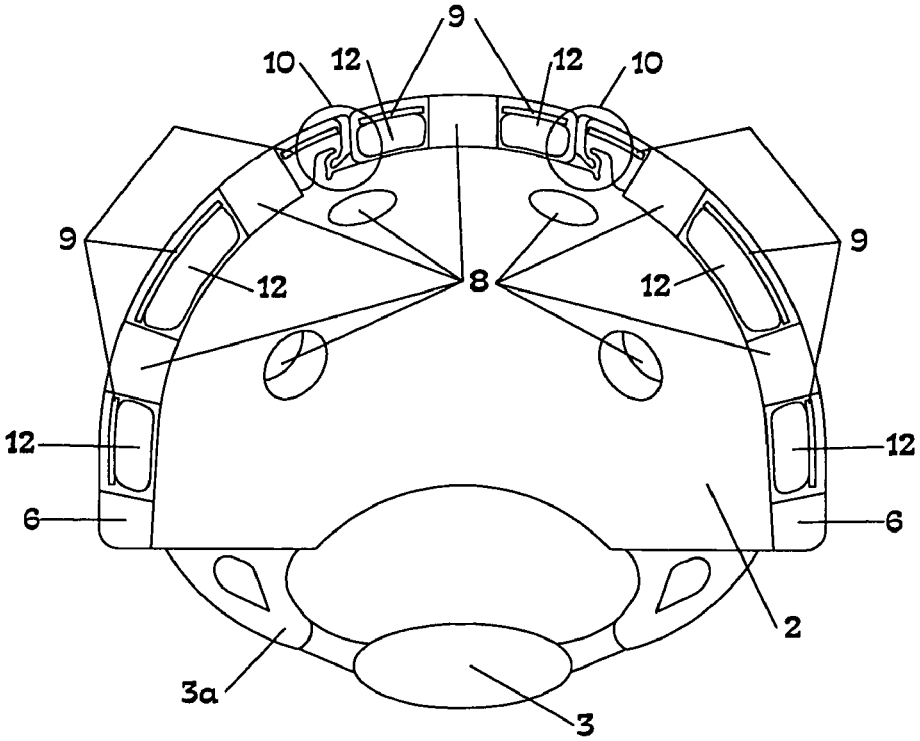
FIG. 14 is a section view of a third embodiment of the present invention.

In a third embodiment of the present invention, depicted in FIG. 14, cushions are added to the first embodiment described above. The cushions are placed adjacent to the inner side of the rigid plates, so that both the rigid plates and the cushions are embedded within the foam insert. Thus, as shown in FIG. 14, the order of materials from outside to inside is: outer covering 1, foam insert 2, rigid plates 9, cushions 12, and foam insert 2.

The cushions may be filled with air, foam (preferably open-celled foam), fluid or a combination of these substances. The cushions may comprise an outer covering, similar to that described in connection with the cushions of the second embodiment, or they may simply be a space within the foam insert. The reason for adding the cushions to the rigid plates and foam insert is because they add yet another mechanism for managing the force of the impact. The rigid plates primarily distribute the force of impact over a greater surface area, whereas the foam insert and cushions primarily dampen the impact. The cushions can be engineered to regulate the rate of deflation resulting from an impact with an object by adjusting the number and size of the nozzles (not shown) to manage the deceleration of the impacting object for the purpose of reducing the potential for head injury. In addition, adding the cushions may allow for the thickness of the foam insert to be decreased while still providing the same level of impact resistance.

The cushions optionally include nozzles (not shown), which may be made of the same materials described in connection with the second embodiment. As in the second embodiment, the nozzles of the third embodiment control the flow of material (e.g., air, foam or fluid) out of the cushion 12 to regulate the deceleration of the baseball or other object hitting the cap. The controlled release of material from the cushion upon impact from an object helps control the rate of cushion deflation and, therefore, helps manage the deceleration of the impacting object. The controlled cushion deflation helps manage the forces of impact for the purpose of reducing the potential for head injury.

The nozzles of the third embodiment are preferably situated so that they vent into the ventilation holes in the rigid plates and foam insert or out the bottom of the safety cap, although they may also be situated so that they vent into adjacent cushions, as described in connection with the second embodiment. The interconnection of nozzles to adjacent cushions would cause the material inside the cushion (air, foam or fluid) to vent through the nozzle to an adjacent cushion upon object impact. The resultant increased pressure in the cushions would provide resistance to impact by managing the rate of cushion deflation and thus impact deceleration. The present invention is not limited to any particular number or location of nozzles.

The third embodiment includes all of the optional features of the first and second embodiments, for example, the eye cutouts, ear cutouts, ponytail cutout, adjustable strap, eye protector and face protector.

Although several preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A safety cap comprising:

(a) at least three rigid plates having edges;

(b) a foam insert; and (c) a flexible outer covering;

wherein the rigid plates are embedded within the foam insert;

wherein the rigid plates are aligned end-to-end to form a single layer;

wherein each rigid plate comprises an inner surface and an outer surface;

wherein the foam insert fully covers the inner and outer surface of each rigid plate;

wherein the foam insert comprises at least two foam joints;

wherein each foam joint comprises overlapping folds of foam material;

wherein the foam joints are comprised of foam and are integral to the foam insert;

wherein the foam joints are positioned between the ends of the rigid plates;

wherein each rigid plate has two longitudinal edges, and the foam joints are parallel to the longitudinal edges of the rigid plates;

wherein the foam joints allow the foam insert to stretch over a wearer's head; and wherein the outer covering limits how far the foam insert stretches.

2. The safety cap of claim 1, wherein the outer covering is comprised of fabric.

3. The safety cap of claim 1, further comprising an eye protector that is permanently attached to the rigid plates.

4. The safety cap of claim 1, further comprising an eye protector that is removably attached to the rigid plates.

5. The safety cap of claim 1, wherein the foam insert comprises a plurality of ventilation holes, wherein each rigid plate comprises a plurality of ventilation holes, and wherein the configuration of the ventilation holes in the foam insert corresponds to the configuration of the ventilation holes in the rigid plates.

6. The safety cap of claim 1, further comprising an occipital extension that is integral with the foam insert; wherein the foam insert comprises a bottom edge; and wherein the occipital extension protrudes downward from the bottom edge of the foam insert at a point roughly equal to the back of a wearer's head.

7. The safety cap of claim 1, further comprising a face protector that is permanently attached to the rigid plates.

8. The safety cap of claim 1, further comprising a face protector that is removably attached to the rigid plates.

9. The safety cap of claim 1, further comprising a plurality of cushions that are situated adjacent to the inner surface of the rigid plates, wherein the cushions are embedded within the foam insert.

10. The safety cap of claim 9, wherein the cushions are filled with air, foam, fluid, or a combination of any of these substances.

11. The safety cap of claim 9, wherein the cushions are a space in the foam insert.

12. The safety cap of claim 9, wherein the cushions comprise nozzles, wherein the rigid plates and foam insert comprise a plurality of ventilation holes, and wherein at least some of the nozzles are situated so that they vent into the ventilation holes in the rigid plates and foam insert and/or out the bottom of the safety cap.

13. The safety cap of claim 9, wherein the cushions comprise nozzles, wherein the rigid plates and foam insert comprise a plurality of ventilation holes, and wherein at least some of the nozzles are situated so that they vent into other cushions.

14. A safety cap comprising:

(a) at least two rigid plates;

(b) a foam insert; and (c) a flexible outer covering;

wherein the rigid plates are embedded within the foam insert;

wherein the rigid plates are aligned end-to-end to form a single layer;

wherein each rigid plate comprises an inner surface and an outer surface;

wherein the foam insert fully covers the inner and outer surface of each rigid plate;

wherein the foam insert comprises at least one foam joint;

wherein each foam joint comprises overlapping folds of foam material;

wherein the foam joints are comprised of foam and are integral to the foam insert;

wherein the foam joints are positioned between the rigid plates;

wherein each rigid plate has two longitudinal edges, and the foam joints are parallel to the longitudinal edges of the rigid plates;

wherein the foam joints allow the foam insert to stretch over a wearer's head; and wherein the outer covering limits how far the foam insert stretches.

* * * * *